US005213358A

United States Patent [19]

Badura

[11] Patent Number: 5,213,358

[45] Date of Patent: May 25, 1993

[54] SKI BINDING

[75] Inventor: Wolfgang Badura, Bad Reichenhall, Fed. Rep. of Germany

[73] Assignee: Buck Werke GmbH & Co., Bad Uberkingen, Fed. Rep. of Germany

[21] Appl. No.: 806,294

[22] Filed: Dec. 13, 1991

[30] Foreign Application Priority Data

Dec. 14, 1990 [DE] Fed. Rep. of Germany ..... 4040069

[51] Int. Cl.[5] ..... A63C 9/0888

[52] U.S. Cl. ..... 280/612; 280/617; 280/634

[58] Field of Search ..... 280/612, 611, 616, 617, 280/623, 625, 626, 628, 632, 634

[56] References Cited

U.S. PATENT DOCUMENTS

| | | | |
|---|---|---|---|
| 3,826,509 | 7/1974 | Smolka | 280/612 |
| 4,121,854 | 10/1978 | Cornu | 280/612 |
| 5,085,453 | 2/1992 | Bildner | 280/612 |

FOREIGN PATENT DOCUMENTS

| | | | |
|---|---|---|---|
| 3808643 | 4/1989 | Fed. Rep. of Germany . | |
| 2418655 | 11/1979 | France | 280/612 |

*Primary Examiner*—Eric D. Culbreth
*Attorney, Agent, or Firm*—Watson, Cole, Grindle & Watson

[57] ABSTRACT

An automatically detachable ski binding includes spaced apart and interconnected toe and heel portions mounted on a ski for holding a ski boot in place thereon. The ski binding includes a mechanical shoe clamping and release system and an electronic controller, the heel portion of the binding including a pivotable clamp with which a spring and a probe engage. The binding is designed in such a manner that the point of application of the probe on the clamp lies between the point of application of the spring on the clamp and the transverse axis about which the clamp pivots, and that the distance between the point of application of the probe and that of the spring and/or the prestress of the spring are selected in such a manner that in the point of application of the probe would specify the relationship, are the same between the desired release values of the vertical and the horizontal torque such that the two different torque values effect the same linear shifting movement of the probe.

2 Claims, 4 Drawing Sheets a
21a
13
18
18c
21
SE
18a
18b
19
15c
17
33
22
SH
23
20
24
25
15d
28
27
10
c
14a
26
29
16
35
11
34
15b
15
15a
14
t
12

Z
X
32
31
30
13
18
21
SE
19
SH
23
20
24
17
FH
12
14
15
11
16
10

SKI BINDING

BACKGROUND OF THE INVENTION

This invention relates to an automatically detachable ski binding having spaced apart and interconnected toe and heel portions mounted on a ski for holding a ski boot in place thereon. More particularly, the ski binding has a mechanical ski boot holding and releasing system and an electronic controller for effecting the release.

U.S. Pat. No. 5,085,453 discloses an electronically controlled release of the clamping force acting on a ski boot which significantly decreases the risk of injury compared to a purely mechanical ski binding release system. This binding releases mechanically as in conventional bindings even if the electronics were to fail once. And, the prior art binding is comparatively simple in its construction despite its dual function as a mechanical and electrical binding, the system including only one compression spring (so-called Z spring) and only one probe for determining the release.

However, the provision of only one such spring and one such probe causes problems attendant to horizontal load and vertical load torques applied to the binding. Extensive medical research (diameter measurement of the upper end of the shin bone has shown that horizontal torque loads (rotary fall) leads significantly sooner to injuries than vertical torque loads (frontal fall). Therefore, in the DIN 7881 it was established that for safety bindings MV/MH=4/1, where MV denotes the vertical triggering or release torque, and MH denotes the horizontal triggering or release torque.

SUMMARY OF THE INVENTION

It is therefore an object of the present invention to improve upon the aforedescribed prior art ski binding but taking into account the different values for the horizontal and maximum trigger torque in a structurally simple yet functionally very precise manner for an automatically detatchable ski binding having a mechanical ski boot holding and release system and an electronic controller.

More particularly, the point of application of the spring force to the boot heel clamp lies at a distance (a) from the transverse pivotal axis of the clamp which distance is greater than the distance (t) from such axis to the point of application of the probe on the clamp. The distance (a–t) and the prestress of the spring are selected such that between the desired release values of the vertical and the horizontal torques the two different torque values effect the same linear shifting movement of the probe triggering electronic release.

The present invention is based on the realization that the displacement of the probe resulting in the release of the binding depends upon a plurality of design dimensions, among them being the distance of the point of application of the probe to the clamp compared to the point of application of the spring force to the clamp, and the prestress of the spring. It is possible through suitable measurement of these distances (with fixed spring prestress) and/or suitable measurement of the prestress (with fixed distance) and/or through a combination of these two measurements to assure that with the use of a single spring and a single probe for the ski binding a precise value for the release is effected for a specific horizontal torque, for a specific other vertical torque and for the spring prestress (shoe clamping force).

DETAILED DESCRIPTION OF THE INVENTION

Figure 1:
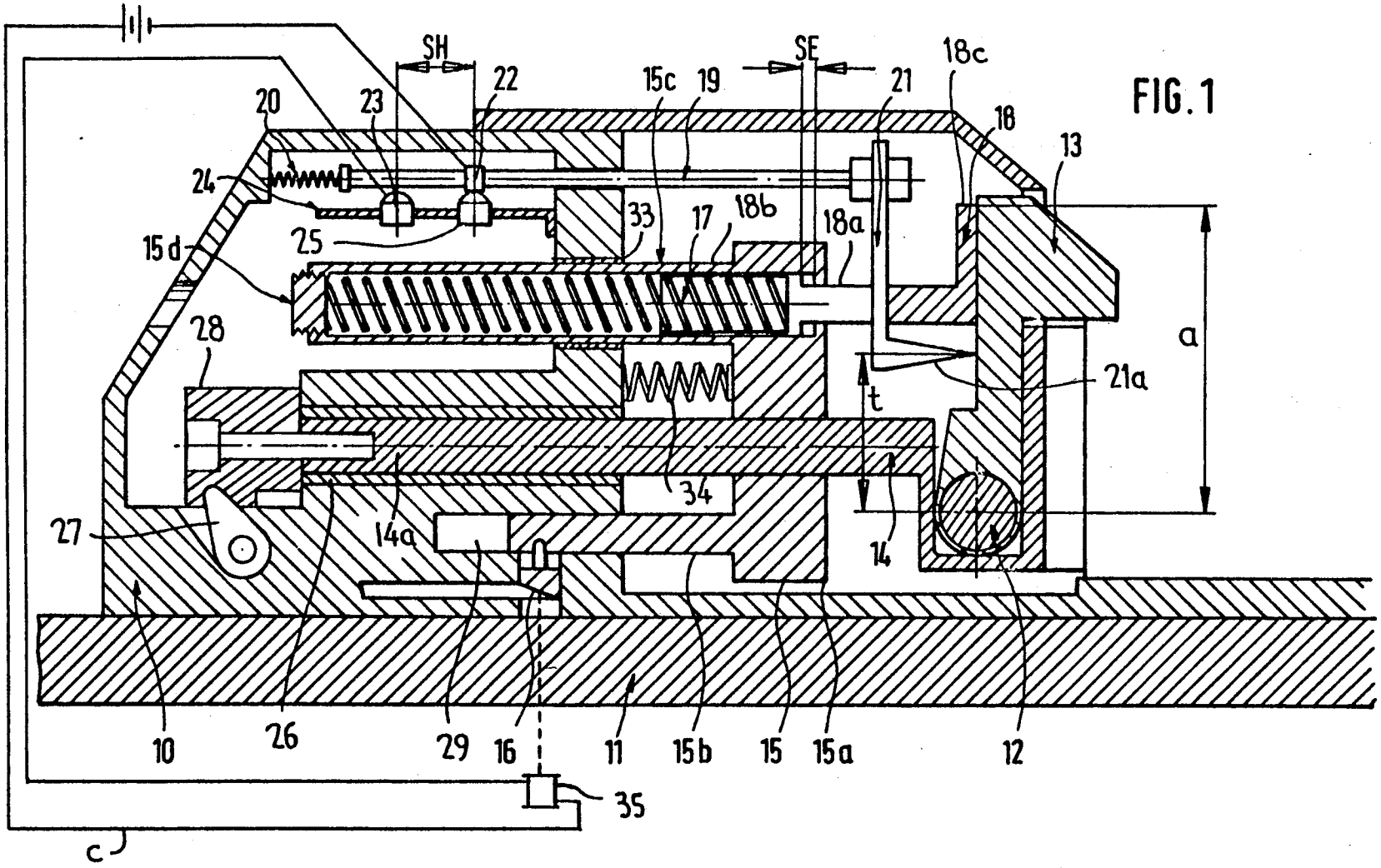
FIG. 1 is a vertical sectional view of the heel portion of the ski binding according to the invention.

Turning now to the drawings wherein like reference characters refer to like and corresponding parts throughout the several views, the heel portion of the present ski binding is diagrammatically shown in FIG. 1 as including a housing mounted on the upper surface of a ski 11 for sliding longitudinal adjustment along the ski in a U-shaped guide (not shown), the housing being connected to a toe portion 31 (FIGS. 2A, 2B) by means of suitable drawstrings or the like (not shown).

Figure 2A:
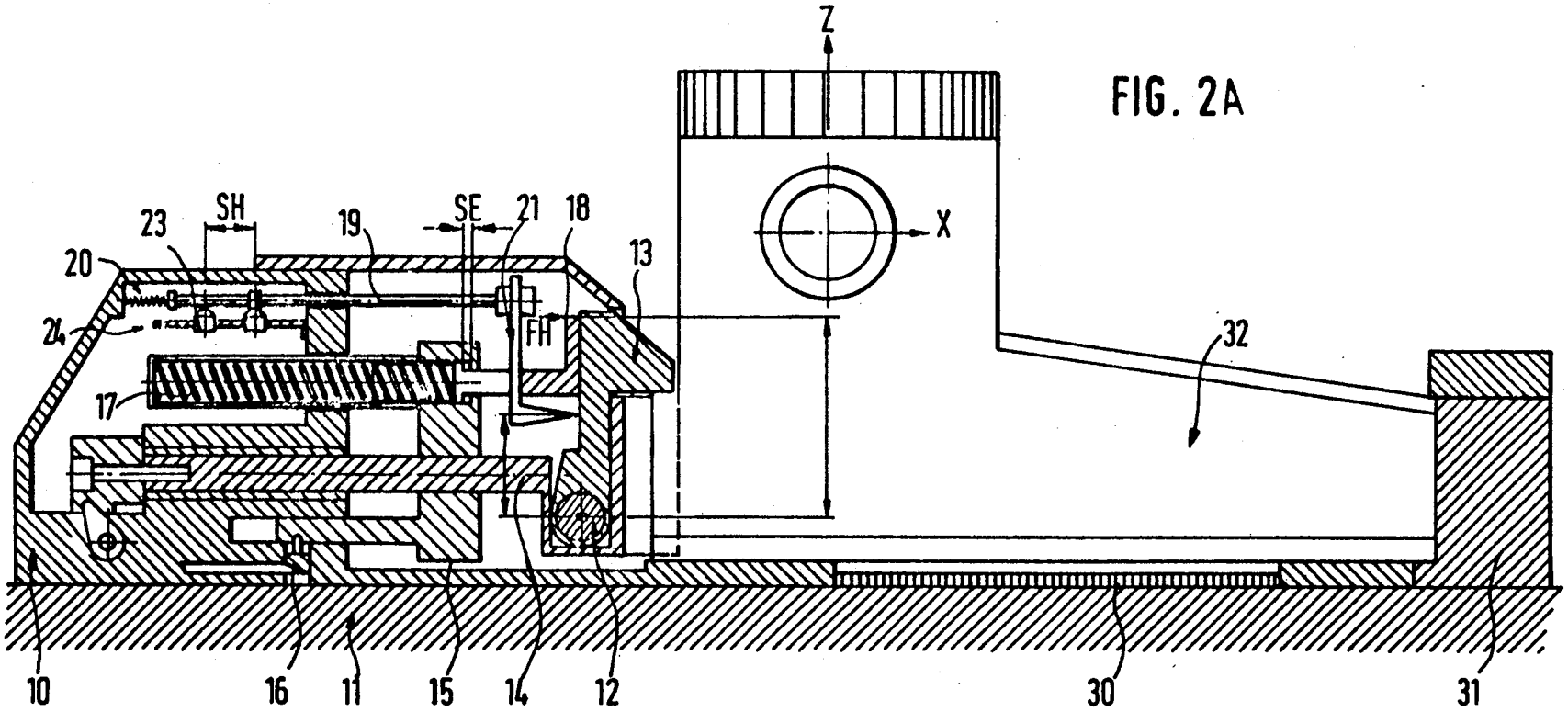
FIG. 2A is a view similar to FIG. 1, but at a slightly reduced scale, further showing the toe portion of the ski binding which together with the heel portion clamps the ski boot in place.

A substantially L-shaped boot heel clamp 13 is mounted to the housing, the clamp jaw of the clamp engaging a suitable shoulder at the heel of the ski boot 32 (FIG. 2A). The clamp is mounted on a transverse pivot pin 12 for pivotable movement about the axis of the pin which may be trunnion or otherwise mounted within a cage-like front end of a heel pusher 14 mounted for longitudinal sliding movement at the front end of the housing. Heel pusher 14 has one or more rearwardly extending support rods **14*a* lying parallel to the ski. The rods extend through suitable bushings 26 within the housing to facilitate longitudinal shifting movement of the heel pusher. A pin or pins 27 are mounted on the housing in releasable engagement with a cap 28 fixed to the rearward end of the rod or rods 14*a*. And, the clamp jaw of clamp 13 protrudes forwardly through a suitable opening in heel pusher 14**, as shown.

A carriage member 15 is mounted to the housing for relative sliding movement in a longitudinal direction. The carriage has a vertical carriage plate **15*a* with bores through which rods 14*a* of the heel pusher slidingly extend. Also, the carriage has a rearwardly extending support rod 15*b* lying parallel to the ski and which extends for sliding movement through a suitable bore 29 of the housing. The carriage further has a hollow spring cage 15*c* rearwardly extending from plate 15*a*, parallel to the ski, and extending through a suitable bushing 33** located in the housing.

A stop 16 or the like having a lock pin in engagement with a suitable recess or the like in rod **15*b* is retractably mounted in the housing for preventing rod 15*b* and thus the entire carriage 15** from shifting.

A helical compression spring (so-called Z spring) 17 is housed within spring cage **15*c*. An adjustable screw plug 15*d* or the like is provided at the rearward end of the spring cage in bearing engagement with the rearward end of the spring. The plug is accessible through an aligned opening in the housing. And, the spring resiliently bears at its forward end against a clamp bearing element 18 which may be substantially L-shaped in cross section. Element 18 has a forked leg 18***a* terminating in a cup 18*b* against which the spring directly bears, and a vertially extending bearing plate 18*c* which flatly engages the rearward face of clamp 13.

Plug 15*d* can be adjusted by the user to set the spring Z-value computed for him (spring prestress). A predetermined resilient spring force is therefore applied to clamp 13 essentially at a point of application FH (FIG. 2A).

An elongated probe rod 19 extends through a suitable opening in the housing for sliding longitudinal movement, the rod lying parallel to the spring cage and being located above the spring. The rod is spring biased in a forward direction toward clamp 13 by a compression spring 20 which acts between an inner wall of the housing and the rearward end of the rod. A probe arm 21 is connected at the forward end of rod 19 and extends downwardly through the space between the tines of fork element 18*a* of the clamp bearing element 18. The probe arm has a forwardly extending pointed bearing element 21*a* in contact engagement with the back face of clamp 13 as resiliently urged by spring 20. Element 21*a* contacts the clamp at a point located a distance t from the central axis of pin 12, which distance is less than the distance (a) between the central axis of pin 12 and the point FH of application of element 18.

An electrical contact element 22 is fixedly mounted on rod 19 at a suitable spacing SH from an on/off electric switch 23 fixedly mounted on a support plate 24 fixed to the housing. Switch 23 is part of an electric circuit c connecting the switch to terminal 25 via a suitable relay or solenoid 35 adapted, when excited, to release stop 16 from carriage rod 15*b*, thus enabling the unrestricted shifting of carriage 15.

Figure 2B:
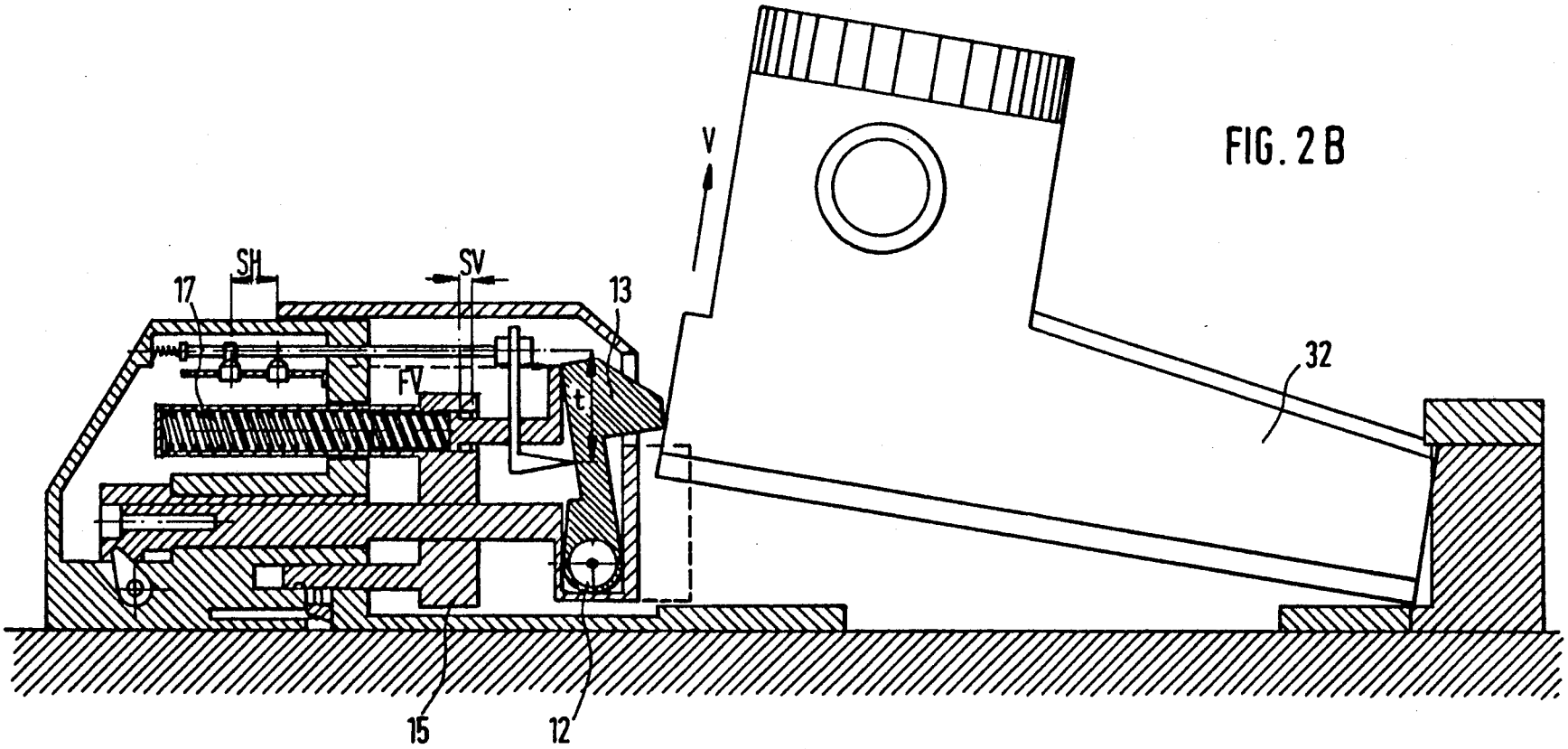
FIG. 2B is similar to FIG. 2A showing the ski binding released as the heel of the ski boot tilts upwardly during a frontal fall.

The basic mode of operation of the heel portion shown in FIG. 1 will be explained with further reference to FIGS. 2A, 2B and 3A, 3B. FIGS. 2A, 2B differ from FIG. 1 only by the additional illustration of toe portion 31, tension bands 30 interconnecting the heel and toe portions, and a ski boot 32 clamped to the ski between the heel and toe portions. As shown in FIG. 2A, the ski boot lies flat relative to the upper surface of ski 11 and is clamped tightly in place by clamp 13.

If the skier experiences a frontal wall while skiing in the boot clamped condition of FIG. 2A, the ski boot is pulled upwardly at its heel in the direction of arrow V of FIG. 2B with the tip of the boot as the point of rotation. As a consequence, clamp 13 is pivoted counterclockwise when viewed in FIG. 2B against the force of spring 17. At the same time probe 21 and its rod 19 are shifted rearwardly and to the left in FIG. 2B through distance SH. Thus, contact element 22 contacts switch 23 for closing the circuit such that the electromagnet or relay 35 is excited and acts to release the pin of stop 16 from its engagement with rod 15*b* of the carriage with the result that suddenly the entire carriage 15 as well as spring 17 shifts relative to the housing in a rearward direction (to the left in FIG. 2B), so that the spring counterpressure on clamp 13 ceases.

Figure 3A:
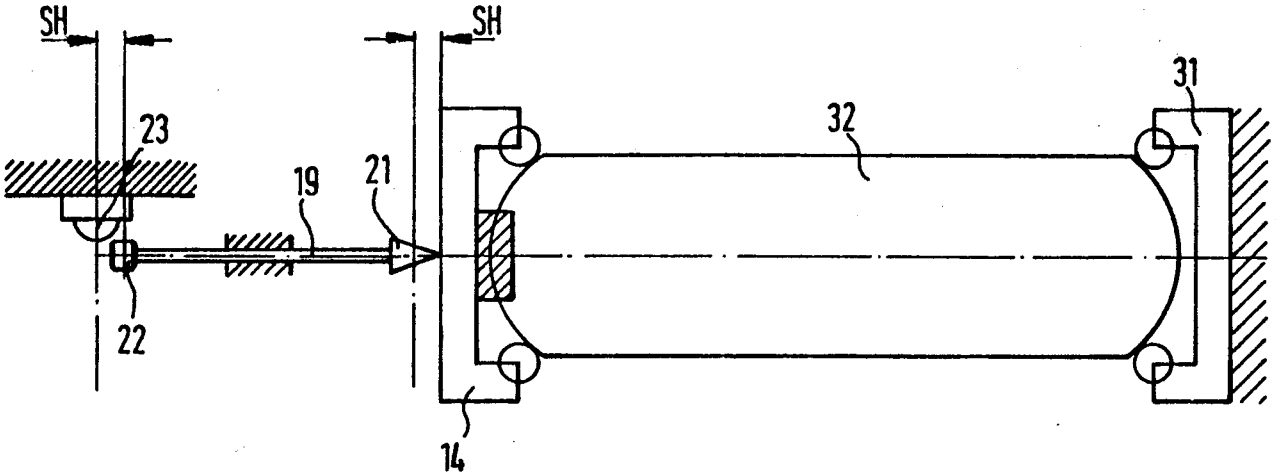
FIG. 3A is top plan schematic view of the ski binding of the invention with the ski boot clamped in place.
Figure 3B:
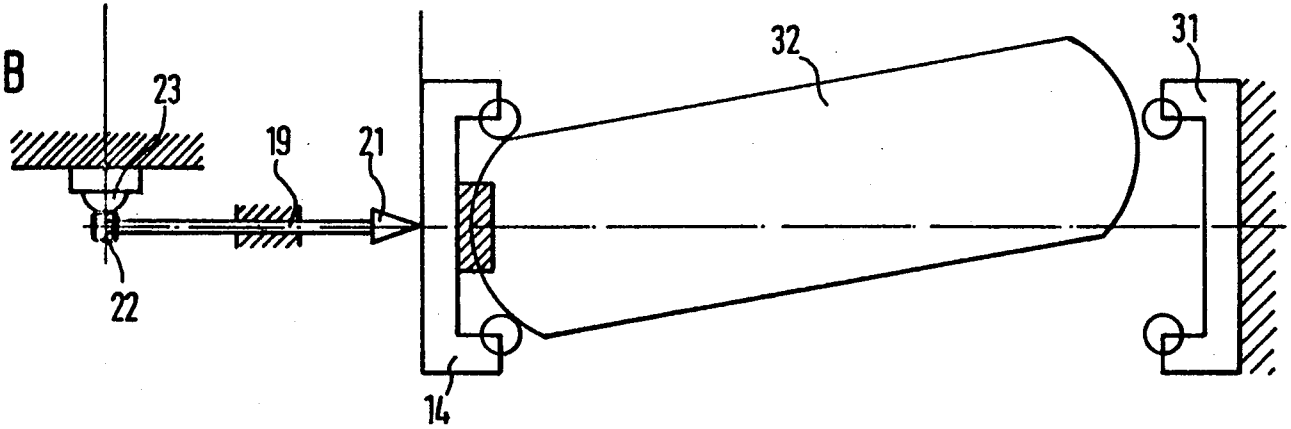
FIG. 3B is a view similar to FIG. 3A showing the ski boot and heel portion released when the boot is rotated in a horizontal plane such as in a rotary fall.

The same release process is also effected for a horizontal torque load applied to the ski boot. With reference to FIGS. 3A and 3B, when the ski boot rotates in a horizontal plane, its heel pushes the clamp and heel pusher rearwardly such that probe 21, its shift rod 19 and contact element 22 likewise shift leftward, when viewed in FIG. 3B, through the distance SH. As soon as contact element 22 reaches switch 23, the ski boot is released as carriage 15 is unlatched and shifts leftward as in the same manner described with reference to FIG. 1 for a frontal load application. As soon as the action forces of the ski boot on the binding have ceased (stepping-out), the binding is moved back into its stepping-in position for the ski boot under the action of a resilient pressing element, such as a coil spring 34, shown in FIG. 1, acting between housing 10 and carriage 15.

From the foregoing description, it can be seen that release of the ski binding in the event of a frontal load application (FIG. 2B) and release of the ski binding in the event of a rotary load application (FIG. 3B) rely on a single spring element, namely spring 17, a condition that assumes, of course, specific precautionary measures. Thus, it is first assumed that according to current medical knowledge horizontal torque loads (rotary fall) lead significantly sooner to injuries than vertical torque loads (frontal fall), a condition that leads to the aforementioned DIN 7881, which establishes for safety bindings: MV/MH=4/1, wherein MV denotes the vertical triggering torque; and wherein MH denotes the horizontal triggering torque. Thus, the heel portion of the ski binding must be harmonized in such a manner that the displacement of clamp 13 that results in a specific horizontal triggering torque (displacement of pin 12 and heel portion 14) must produce the same displacement of probe rod 19 and thus of contact element 22 through distance SH as the pivoting of clamp 13, which results from the four-fold vertical torque M,V, about the axis of pin 12. This is effected because the point FH (FIG. 2A) of application of element 18 and thus of spring 17 at clamp 13 is at a greater distance from the axis of pivot pin 12 compared to the point of application of probe arm 21*a* at clamp 13 from the same transverse axis, and that the distance (a–t) between these two points of application is chosen correspondingly.

The prestress of spring 17, however, is another parameter. Spring 17 functions to resiliently press the ski boot via heel pusher 14 with a predetermined force against clamp 13, i.e., clamping the ski boot tight. However, it is also known that the spring characteristic for the helical spring is not linear, which explains why a change in the spring prestress with a fixed distance (a–t) of the aforementioned spring/probe application results in a change in the relationship of horizontal to the vertical triggering torque. Theoretical considerations have shown that the aforementioned parameters can be determined mathematically, i.e., with specified dimensions of the moveable parts (carriage, clamp, probe) and with a specified Z-spring, curves can be drawn that show the function between a relationship MV/MH and the prestress of spring 17. Thus, such curves facilitate not only the choice of suitable springs and the determination of the appropriate points of application of probe and/or clamp bearing element on the clamp but also enable, for example, determining regions within which the relationship MV/MH changes only slightly as a function of the spring prestress, so that the ski binding user can be allowed to optionally change the spring prestress in this region, without such change causing a change in the relationship MV/MH. In any event it is both experimentally and thearetically possible to achieve the desired result through a suitable choice of the aforementioned parameters. It is even further faciliated by designing, for example, probe 21 and/or elements 18 so as be variable lengthwise or directionally, or by interchanging these elements as well as that of spring 17, for elements of different predetermined lengths.

The invention has been described without detailing the subassemblies which are known from the art as disclosed in U.S. Pat. No. 5,085,453 and which are therefore not illustrated for the sake of clarity. Thus, a second electric switch on rod 19 may serve to connect the batteries for the electromagnet directly before the release. A timing element may also be provided to avoid a binding release when the load jolts are present for a very short period of time. And, locking element 16 could comprise spheres which are arranged on the circumference of bolt 15*b* and can be actuated by a sleeve-like extension of the electromagnetic armature.

Obviously, many modifications and variations of the present invention are made possible in the light of the above teachings. For example, the forked element 18*a* design and the probe design could vary so long as they intersect without interference.

It is therefore to be understood that within the scope of the appended claims the invention may be practiced otherwise than as specifically described.

What is claimed is:

1. An automatically detachable ski binding including spaced apart and interconnected toe and heel portions mounted on a ski for holding a ski boot in place thereon, said heel portion comprising a housing, a carriage member mounted to said housing for longitudinal sliding movement, means on said housing for locking said carriage in a pedetermined longitudinal position and for releasing said carriage from said position, a heel clamp mounted within said housing for pivotal movement about a transverse axis between a heel clamping position and a heel release position, said clamp being further mounted for longitudinal sliding movement relative to said housing from said clamping position and said heel release position, a longitudinally movable elongated probe element mounted to said housing, one end of said probe element being in point contact engagement with said clamp, electronic means including an on/off switch fixedly mounted on said housing for electronically controlling said locking and releasing means, an electrical contact element mounted on said probe, said contact element being spaced a predetermined longitudinal distance from said switch in said heel clamping position, means applying a spring force to said clamp for urging said clamp into said heel clamping position, said urging means including a compression spring acting between said carriage and said clamp, means for prestressing said spring for adjusting said spring force, said probe element extending parallel to and above said spring, said one end of said probe element being connected by a downwardly extending arm on said probe element, said spring force applying means including an open leg element and an upwardly extending element resiliently bearing against said clamp, said arm extending without inteference through said leg element, a distance (a) from said transverse axis to a point of application of said spring force to said clamp being greater than a distance (t) from said transverse axis to said point contact of said probe element one end, the distance (a–t) and the prestress of said spring being selected such that the pivoted movement of said clamp to said release position effects sliding movement of said probe element a predetermined distance for contact said switch by said contact piece, and such that any sliding movement of said clamp to said release position is substantially through said predetermined distance.

2. The ski binding according to claim 1, wherein said leg element comprises a forked element.

* * * * *